US010907606B2

(12) United States Patent
Inoue et al.

(10) Patent No.: US 10,907,606 B2
(45) Date of Patent: Feb. 2, 2021

(54) IGNITION DEVICE

(71) Applicant: Mitsubishi Electric Corporation, Tokyo (JP)

(72) Inventors: Takahiro Inoue, Tokyo (JP); Taichiro Tamida, Tokyo (JP); Ryota Asakura, Tokyo (JP); Tomokazu Sakashita, Tokyo (JP); Takashi Hashimoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/646,151

(22) PCT Filed: May 24, 2018

(86) PCT No.: PCT/JP2018/019978
§ 371 (c)(1),
(2) Date: Mar. 11, 2020

(87) PCT Pub. No.: WO2019/092907
PCT Pub. Date: May 16, 2019

(65) Prior Publication Data

US 2020/0271084 A1 Aug. 27, 2020

(30) Foreign Application Priority Data

Nov. 9, 2017 (JP) ..... 2017-216413

(51) Int. Cl.
*F02P 9/00* (2006.01)
*F02P 17/12* (2006.01)

(52) U.S. Cl.
CPC ..... *F02P 9/007* (2013.01); *F02P 17/12* (2013.01); *F02P 2017/125* (2013.01)

(58) Field of Classification Search
CPC .... F02P 3/01; F02P 9/007; F02P 17/12; F02P 2017/125; F02P 23/00; F02P 23/04
See application file for complete search history.

(56) References Cited

U.S. PATENT DOCUMENTS 5,568,801 A * 10/1996 Paterson ..... F02P 9/007 123/143 B
2004/0129241 A1* 7/2004 Freen ..... F02P 23/04 123/143 B (Continued)

FOREIGN PATENT DOCUMENTS

DE 102010044845 B3 * 12/2011 ..... F02P 23/04
JP 2008232122 A * 10/2008 ..... F02P 23/04

(Continued)

OTHER PUBLICATIONS

International Search Report and Written Opinion dated Jul. 17, 2018 for PCT/JP2018/019978 filed on May 24, 2018, 9 pages including English Translation of the International Search Report.

*Primary Examiner* — John M Zaleskas
(74) *Attorney, Agent, or Firm* — Xsensus LLP

(57) ABSTRACT

An ignition device according to the present invention includes: an ignition plug, which includes a first electrode, a second electrode, and a dielectric body arranged between the electrodes; an AC power supply configured to generate an AC voltage to be applied between the electrodes; a thermal plasma detection portion configured to output a thermal plasma occurrence signal when thermal plasma has occurred between the electrodes; and an application time period determination portion configured to determine an application time period for the AC voltage during one cycle of the internal combustion engine in advance before the application, and when the thermal plasma occurrence signal is received while the AC voltage is being applied based on (Continued)

the application time period, change the application time period so as to shorten the application time period.

8 Claims, 6 Drawing Sheets

(56) References Cited

U.S. PATENT DOCUMENTS

2007/0266979 A1* 11/2007 Nagamine ..... F02D 41/3041 123/143 B
2009/0031984 A1* 2/2009 Shiraishi ..... F02P 23/045 123/260
2009/0031988 A1* 2/2009 Shiraishi ..... F02P 23/04 123/406.19
2009/0126668 A1* 5/2009 Shiraishi ..... H01T 13/50 123/145 A
2009/0126684 A1* 5/2009 Shiraishi ..... F02D 41/3041 123/406.12
2010/0147239 A1* 6/2010 Lu ..... F02P 23/04 123/169 R
2010/0212620 A1* 8/2010 Shimizu ..... F02P 15/02 123/143 B
2010/0282198 A1* 11/2010 Hampton ..... F02P 23/04 123/143 B
2011/0048355 A1* 3/2011 Makarov ..... F02P 9/007 123/143 B
2011/0114071 A1* 5/2011 Freen ..... F02P 23/04 123/623
2011/0197865 A1* 8/2011 Hampton ..... F02P 23/045 123/623
2011/0297132 A1* 12/2011 Schremmer ..... F02P 23/04 123/598
2011/0305998 A1* 12/2011 Toedter ..... H01T 19/02 431/2
2012/0063054 A1* 3/2012 Burrows ..... F02P 23/04 361/256
2012/0145136 A1* 6/2012 Burrows ..... F02P 9/007 123/608
2012/0180742 A1* 7/2012 Burrows ..... F02P 15/10 123/143 B
2012/0192825 A1* 8/2012 Trump ..... F02P 23/04 123/143 R
2012/0249006 A1* 10/2012 Burrows ..... F02P 23/04 315/209 T
2012/0249163 A1* 10/2012 Burrows ..... F02P 23/04 324/633
2012/0260898 A1* 10/2012 Schremmer ..... F02P 3/06 123/598
2013/0013167 A1* 1/2013 Schremmer ..... F02P 23/045 701/102
2013/0049601 A1* 2/2013 Bohne ..... F02P 9/007 315/129
2013/0319384 A1* 12/2013 Trump ..... F02P 3/01 123/623
2014/0144402 A1* 5/2014 Okabe ..... H01T 13/52 123/169 EL
2014/0174392 A1* 6/2014 Burrows ..... F02B 5/02 123/143 B
2014/0174416 A1* 6/2014 Okabe ..... H01T 13/52 123/608
2014/0182538 A1* 7/2014 Burrows ..... F02P 23/04 123/143 B
2014/0226252 A1* 8/2014 Freen ..... F02P 17/12 361/253
2014/0358399 A1* 12/2014 Schremmer ..... F02P 17/12 701/101
2015/0167623 A1* 6/2015 Sanders ..... F02P 3/08 123/605
2015/0260147 A1* 9/2015 Schenk ..... F02P 3/01 123/406.19
2016/0013623 A1* 1/2016 Zheng ..... H01T 15/00 361/263
2016/0102647 A1* 4/2016 Hashimoto ..... F02P 3/0876 315/283
2016/0222940 A1* 8/2016 Burrows ..... F02B 5/02
2017/0022962 A1* 1/2017 Burrows ..... H01T 19/00
2017/0096979 A1* 4/2017 Kinoshita ..... F02P 3/05
2017/0122281 A1* 5/2017 Imanaka ..... F02P 5/1502
2017/0167464 A1* 6/2017 Sanders ..... F02P 3/08
2017/0276114 A1* 9/2017 Kinoshita ..... F02P 3/053
2017/0298894 A1* 10/2017 Idicheria ..... H01T 13/02
2017/0314523 A1* 11/2017 Burrows ..... H01T 19/00
2017/0331262 A1* 11/2017 Tanaya ..... H01T 19/00
2018/0135589 A1* 5/2018 Tanaya ..... F02P 7/06
2018/0301877 A1* 10/2018 Tamida ..... F02P 23/04
2018/0306162 A1* 10/2018 Koda ..... F02P 5/103
2019/0186454 A1* 6/2019 Asakura ..... F02P 9/007

FOREIGN PATENT DOCUMENTS

JP 2009-36125 A 2/2009
JP 2009-121410 A 6/2009
JP 2012-184718 A 9/2012
JP 2014-513760 A 6/2014
JP 2015187418 A * 10/2015
JP 2016-506474 A 3/2016
JP 2017-72045 A 4/2017
WO 2012/138676 A1 10/2012
WO 2014/100800 A1 6/2014

* cited by examiner

IGNITION DEVICE

CROSS-REFERENCE TO RELATED APPLICATIONS

The present application is based on PCT filing PCT/JP2018/019978, filed May 24, 2018, which claims priority to JP 2017-216413, filed Nov. 9, 2017, the entire contents of each are incorporated herein by reference.

TECHNICAL FIELD

The present invention relates to an ignition device for an internal combustion engine, which uses a barrier discharge.

BACKGROUND ART

In an internal combustion engine, ignition is unstable under a lean combustion environment or a high exhaust gas recirculation (EGR) environment, which aims at an improvement in fuel efficiency. In view of this, there is proposed a barrier-discharge-type ignition device capable of volumetric ignition (see, for example, Patent Literature 1).

CITATION LIST

Patent Literature

[PTL 1] JP 2014-513760 A1

SUMMARY OF INVENTION

Technical Problem

As the invention according to Patent Literature 1, there is proposed a technology for detecting a transition from low-temperature plasma to thermal plasma to interrupt the thermal plasma in an ignition device configured to form low-temperature plasma through use of a short-pulse power supply and an ignition plug having all metal electrodes exposed to an air-fuel mixture.

However, the invention according to Patent Literature 1 relates to the ignition device configured to generate a barrier discharge through use of the AC power supply and the ignition plug having at least one of the electrodes covered with a dielectric body. Therefore, when the dielectric body electrically breaks down, there is no way to intentionally generate low-temperature plasma, thereby inhibiting the ignition device from performing its normal operation. In view of this, it is required to employ a control scheme for avoiding a failure of the ignition device while maintaining minimum ignition performance under an abnormal state in which the dielectric body has electrically broken down.

The present invention has been made in order to solve the above-mentioned problem, and has an object to obtain a barrier-discharge-type ignition device capable of avoiding a failure while maintaining minimum ignition performance even when a dielectric body of an ignition plug electrically breaks down.

Solution to Problem

An ignition device according to one embodiment of the present invention includes: an ignition plug, which is arranged in an internal combustion engine, and includes a first electrode, a second electrode, and a dielectric body arranged between the first electrode and the second electrode; an AC power supply configured to generate an AC voltage to be applied between the first electrode and the second electrode; a thermal plasma detection portion configured to detect whether thermal plasma has occurred between the first electrode and the second electrode, and when the thermal plasma is detected, output a thermal plasma occurrence signal; and an application time period determination portion configured to determine an application time period for the AC voltage during one cycle of the internal combustion engine in advance before the application, and when the thermal plasma occurrence signal is received while the AC voltage is being applied based on the application time period, change the application time period so as to shorten the application time period.

Advantageous Effects of Invention

According to the present invention, there is provided a configuration for performing control to shorten a predetermined application time period when an occurrence of thermal plasma is detected while the AC voltage is being applied to the ignition plug based on the application time period. As a result, it is possible to obtain a barrier-discharge-type ignition device capable of avoiding a failure while maintaining minimum ignition performance even when the dielectric body of the ignition plug electrically breaks down.

DESCRIPTION OF EMBODIMENTS

An ignition device according to preferred embodiments of the present invention is described below with reference to the accompanying drawings.

First Embodiment

Figure 1:
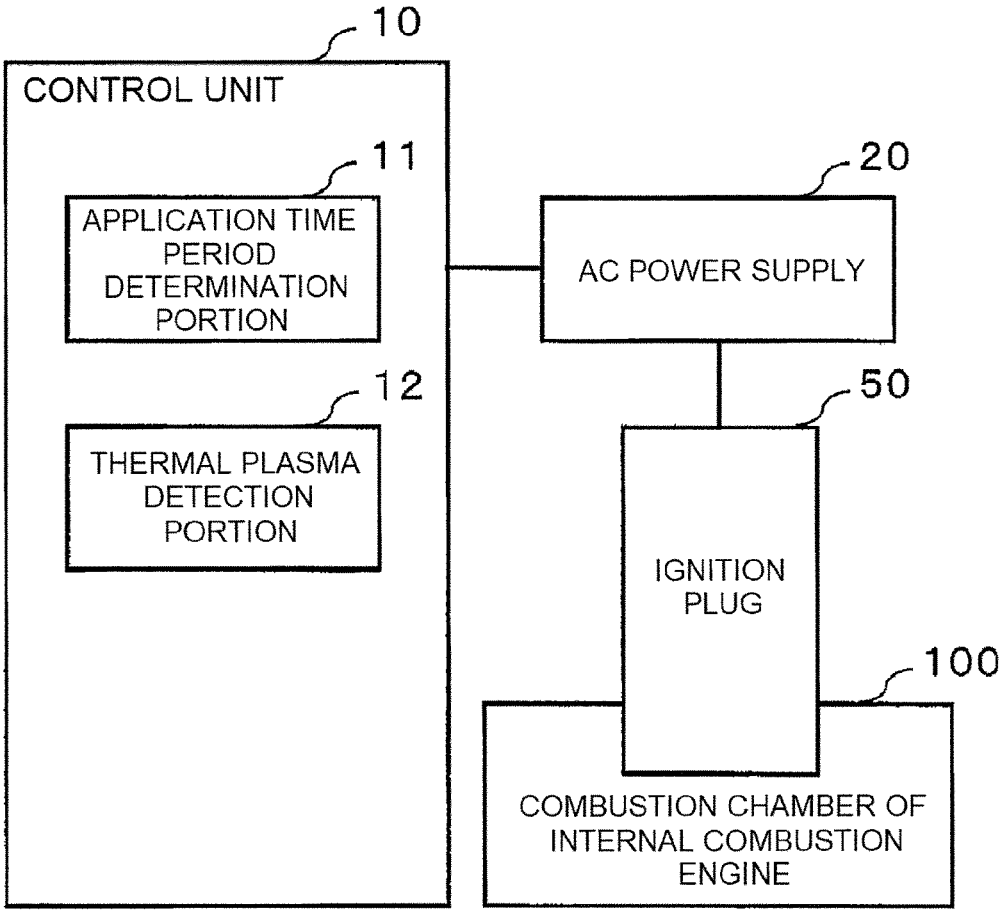
FIG. 1 is a schematic diagram for illustrating an example of a configuration of an ignition device according to a first embodiment of the present invention.

FIG. 1 is a schematic diagram for illustrating an example of a configuration of an ignition device according to a first embodiment of the present invention. The ignition device according to the first embodiment has a technical feature of being capable of igniting fuel with stability without causing a failure in the ignition device even when an ignition plug is damaged.

The ignition device illustrated in FIG. 1 includes a control unit 10, an AC power supply 20, and an ignition plug 50. The AC power supply 20 and the ignition plug 50 are electrically connected to each other. One end of the ignition plug 50 is arranged in a combustion chamber 100 of an internal combustion engine. The AC power supply 20 generates an AC voltage. When an AC voltage is applied to the ignition plug 50, the ignition plug 50 causes a barrier discharge to occur in the combustion chamber 100 of the internal combustion engine.

The control unit 10 is electrically connected to the AC power supply 20. The control unit 10 also includes an application time period determination portion 11 configured to determine a time period during which an AC voltage is to be applied with one ignition, and a thermal plasma detection portion 12 configured to detect the presence or absence of thermal plasma at the ignition plug 50 to output the presence or absence as a thermal plasma occurrence signal.

The AC power supply 20 in the first embodiment has a function of converting a DC voltage into an AC voltage and a function of boosting the AC voltage. In this case, the AC voltage is not limited to a sine wave as long as a barrier discharge can be caused to occur, and may be a square wave.

Figure 2:
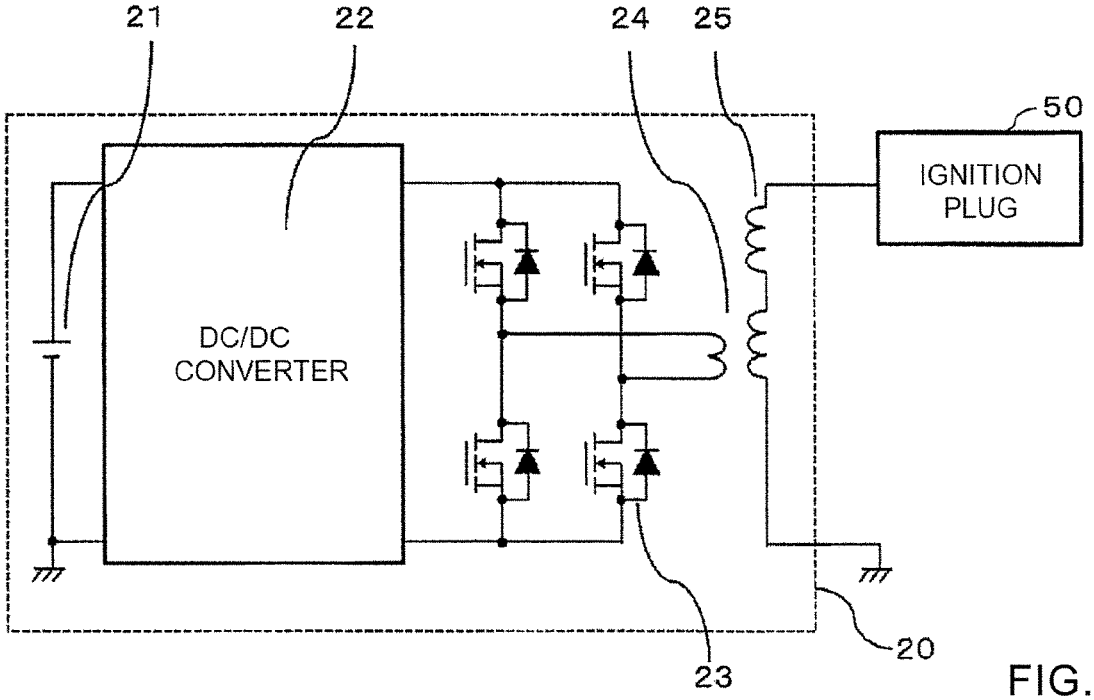
FIG. 2 is a circuit diagram for illustrating an example of an AC power supply 20 in the first embodiment of the present invention.

FIG. 2 is a circuit diagram for illustrating an example of the AC power supply 20 in the first embodiment of the present invention. The AC power supply 20 illustrated in FIG. 2 includes a DC power supply 21, a DC/DC converter 22, switching elements 23, a step-up transformer 24, and a resonance coil 25.

The DC power supply 21 used in the AC power supply 20 corresponds to a DC voltage of 12 V, which is a general automobile battery voltage. The AC power supply 20 boosts the DC voltage from the DC power supply 21 by 2 times to 40 times by the DC/DC converter 22, then converts the DC voltage into an AC voltage through use of the switching elements 23, and further boosts the AC voltage by the step-up transformer 24 and the resonance coil 25. The conversion from DC into AC is performed by a full bridge circuit using a total of four switching elements 23, two of which are connected in series, and the other two of which are connected in parallel.

In the first embodiment, the conversion from DC into AC is performed by a full bridge circuit, but a half bridge circuit may be used for the conversion. When the half bridge circuit is used, only two switching elements 23 are required, but a double voltage is applied to the switching elements 23 even with the same step-up ratio. Therefore, it is required to select the switching elements 23 each having a higher withstand voltage.

The step-up transformer 24 boosts the AC voltage generated through use of the switching element 23. A ratio between the numbers of turns of a primary winding and a secondary winding in the step-up transformer 24 is set to from 2 times to 200 times. One end on the secondary winding side is connected to the ignition plug 50 through the resonance coil 25, and the other end on the secondary winding side is set at the same potential as that of an engine casing. The AC voltage boosted by the step-up transformer 24 is further boosted through use of LC resonance.

An electrostatic capacitance C component in the LC resonance is a combination of the stray capacitance of the ignition plug 50 and the stray capacitance of a wiring extending from the resonance coil 25 to the ignition plug 50. Meanwhile, an inductance L component in the LC resonance is a combination of the inductance of the resonance coil 25, the leakage inductance of the step-up transformer 24, and the inductance of a wiring extending from the step-up transformer 24 to the ignition plug 50.

The step-up transformer 24 is not always required to be provided as a component, and the system can be downsized when the step-up transformer 24 is not provided as a component. However, when the step-up transformer 24 is not provided as a component, it is required to cause a barrier discharge to occur by boosting the voltage only by the DC/DC converter 22 and the LC resonance. Therefore, a load imposed on the DC/DC converter 22 increases, and there is a risk that a barrier discharge may not occur due to insufficient voltage boosting in the first place.

In contrast, when the step-up transformer 24 is provided as a component, it is possible to reduce a step-up ratio required for the DC/DC converter 22 and the LC resonance.

In the same manner, the resonance coil 25 is not always required to be provided as a component, and the system can be downsized when the resonance coil 25 is not provided as a component. In contrast, when the resonance coil 25 is provided as a component, it is possible to lower the resonance frequency of the AC voltage in the LC resonance. This allows a more inexpensive element to be used as the switching element 23, and also facilitates insulation measures in a high voltage path.

As the resonance coil 25, for example, an iron-core reactor using a ferrite core may be employed, or an air-core reactor using no core material may be employed. When the iron-core reactor is employed, a larger inductance can be obtained. Meanwhile, when the air-core reactor is employed, it is not required to take the heat generation of a core material into consideration.

In another case, the voltage from the DC power supply 21 may be directly converted into AC by the switching element 23 without being boosted by the DC/DC converter 22. In the case of the direct conversion into AC, there is an advantage that the DC/DC converter 22 is not required. In contrast, the step-up ratio required for the step-up transformer 24 and the LC resonance using the resonance coil 25 and the ignition plug 50 increases, and hence the size of the system increases.

Figure 3:
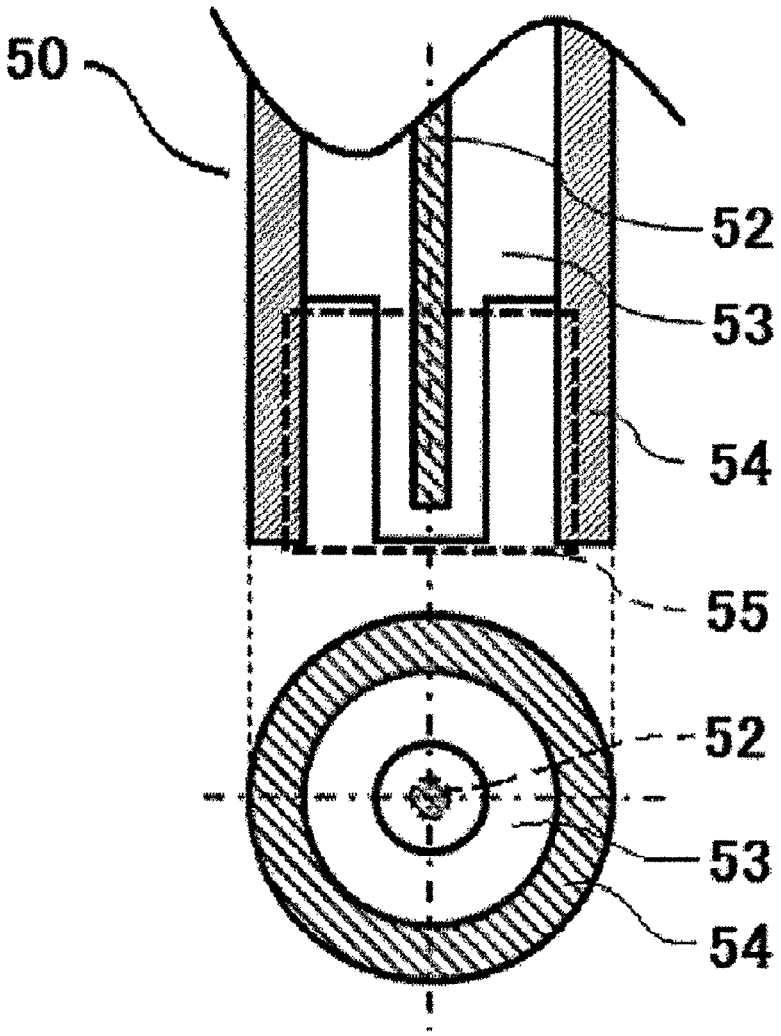
FIG. 3 is a schematic view for illustrating an example of an ignition plug of the ignition device according to the first embodiment of the present invention.

FIG. 3 is a schematic view for illustrating an example of the ignition plug 50 of the ignition device according to the first embodiment of the present invention. The ignition plug 50 in the first embodiment includes electrodes configured to cause a barrier discharge to occur. More specifically, the ignition plug 50 includes a first electrode 52, a dielectric body 53, a second electrode 54, and a discharge region 55.

The ignition plug 50 has a structure in which at least one of the first electrode 52 and the second electrode 54 is covered with the dielectric body 53. The first electrode 52 (center electrode 52), which is a rod-shaped conductor, is arranged on the center axis of the ignition plug 50. The first electrode 52 has one end connected to the resonance coil 25 and the other end reaching the discharge region 55.

The center electrode 52 excluding a portion thereof connected to the resonance coil 25 is covered with the dielectric body 53 in all directions. The entire periphery of the dielectric body 53 is covered with the second electrode 54 (peripheral electrode 54). That is, the center electrode 52, the dielectric body 53, and the peripheral electrode 54 have a common center axis, and are all integrally fixed.

In the discharge region 55, a gap (discharge gap) of 3.0 mm or less is formed between the dielectric body 53 and the peripheral electrode 54. In this discharge gap, a barrier discharge for igniting an air-fuel mixture occurs. Through the formation of the gap, a material thickness of the dielectric body 53 is reduced in the discharge region 55 to as thin as from 0.1 mm to 5 mm.

In the discharge region 55, it is not always required to form a gap between the dielectric body 53 and the peripheral electrode 54. When the gap is not formed, there occurs a barrier discharge along the creepage face of the dielectric body 53 from a position at which three substances of the dielectric body 53, the peripheral electrode 54, and ambient gas are brought into contact with one another.

The barrier discharge on the creepage face is a discharge disadvantageous for ignition due to an influence of a flame-out action. Meanwhile, the barrier discharge on the creepage face is advantageous in that power consumption can be suppressed and that the discharge start voltage can be lowered.

As the material thickness of the dielectric body 53 decreases, the electrical or mechanical strength of the dielectric body 53 decreases, but the discharge gap can be set larger, which is advantageous for ignition. In contrast, as the material thickness of the dielectric body 53 is set larger, the electrical or mechanical strength is further improved, but the discharge gap decreases, which is disadvantageous for ignition. In addition, when the material thickness of the dielectric body 53 is set larger, thermal stress due to a temperature gradient in a radial direction increases.

The dielectric body 53 and the peripheral electrode 54 other than the discharge region 55 may be in contact with each other, or air or an air-fuel mixture made of air and fuel may exist therebetween. The dielectric body 53 and the peripheral electrode 54 may be in contact with each other only partially in the discharge region 55, and by adjusting the area of a contact region between the dielectric body 53 and the peripheral electrode 54, it is possible to adjust the temperature of the ignition plug 50 while the engine is running.

Figure 4:
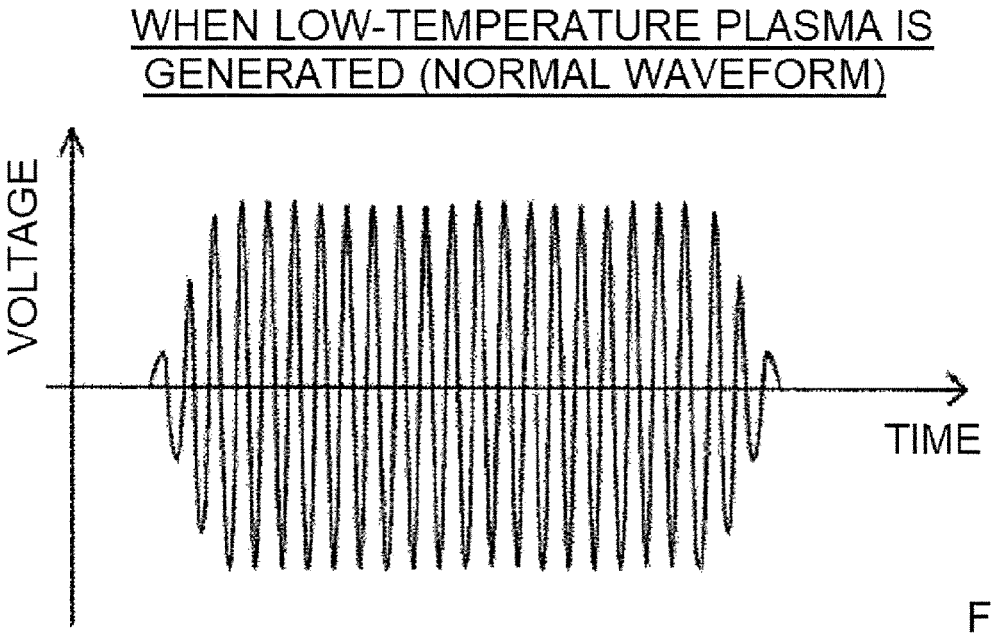
FIG. 4 is a schematic diagram for illustrating an example of a waveform of an AC voltage to be applied to the ignition plug under a normal state in the ignition device according to the first embodiment of the present invention.

FIG. 4 is a schematic diagram for illustrating an example of a waveform of the AC voltage to be applied to the ignition plug 50 under a normal state in the ignition device according to the first embodiment of the present invention. As illustrated in FIG. 4, an AC voltage over a plurality of cycles is applied to the ignition plug 50 with one ignition. As a result, the barrier discharge is carried out for a predetermined time period, and low-temperature plasma is formed, to thereby ignite the fuel.

The voltage gradually increases in the initial stage of a voltage waveform illustrated in FIG. 4, which indicates a characteristic of the LC resonance. A time period during which an AC voltage is to be applied with one ignition, including a period for the LC resonance, is hereinafter referred to simply as "application time period".

The application time period determination portion 11 has a function of determining the application time period prior to the ignition. The longer application time period is advantageous in stable ignition, while the shorter application time period is advantageous in terms of power consumption. For example, in regard to the operating condition of the internal combustion engine, the application time period can be set longer under a condition in which the ignition tends to be unstable, and can be set shorter under a condition in which the ignition tends to be stable.

The application time period is not always required to be determined by the ignition device. In an exemplary case of an automobile, an ECU may determine the application time period and transmit information on the application time period to the AC power supply 20 depending on the length of an ignition signal. In addition to the application time period, it is also possible to adjust the power consumption with one ignition by increasing or decreasing the frequency at which the AC power supply 20 oscillates.

When the voltage is constant, the power consumption is proportional to the frequency. Meanwhile, when the voltage is boosted through use of the LC resonance, the voltage can be lowered to reduce the power consumption by increasing a distance from the resonance frequency. The ignition device according to the first embodiment selectively adjusts the application time period and the frequency, to thereby be able to perform control between, for example, a high-output short-time-period discharge at high rotation of the internal combustion engine and a low-output long-time-period discharge at low rotation thereof.

The AC voltage waveform is not limited to a sine wave, and may be, for example, a square wave. The square wave has stricter requirement specifications required for the AC power supply 20, but can cause a larger amount of discharge to occur than that in the case of the sine wave, which is advantageous in reliable ignition. In contrast, the use of the sine wave is advantageous in downsizing and cost reduction.

Figure 5:
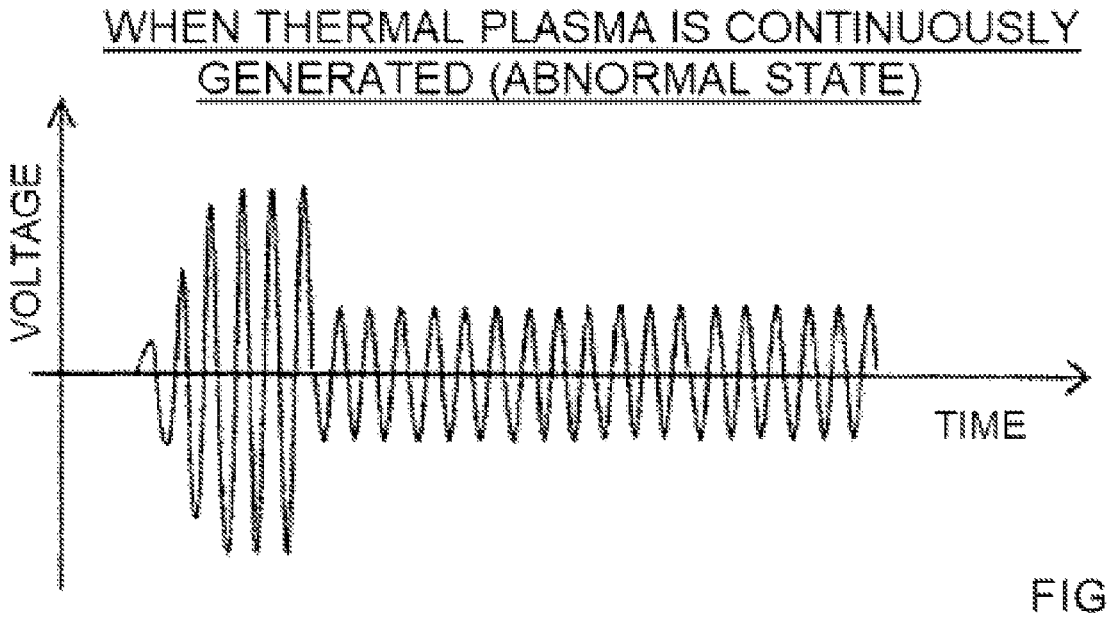
FIG. 5 is a schematic diagram for illustrating an example of a waveform of the AC voltage to be applied to the ignition plug under an abnormal state in the ignition device according to the first embodiment of the present invention.

FIG. 5 is a schematic diagram for illustrating an example of a waveform of the AC voltage to be applied to the ignition plug 50 under an abnormal state in the ignition device according to the first embodiment of the present invention. In this case, the "abnormal state" refers to a state in which the dielectric body 53 in the discharge region 55 of the ignition plug 50 has been damaged and there is a path having no dielectric body 53 interposed in the gap between the center electrode 52 and the peripheral electrode 54 in the combustion chamber 100.

Typical causes of the damage done to the dielectric body 53 include an electrical penetration failure due to the applied AC voltage, an impact failure due to the collision of foreign matter, and damage due to thermal stress. Even for any one of the causes, thermal plasma is generated when the dielectric body 53 is so damaged as to expose the central electrode 52. Thus, it becomes impossible to cause a barrier discharge to occur.

The voltage waveform illustrated in FIG. 5 indicates a phenomenon in which the voltage gradually rises due to LC resonance in the initial stage of the application of the AC voltage, and thermal plasma is caused to occur after the discharge start voltage is reached, to thereby cause the voltage to drop. The presence or absence of thermal plasma in the ignition plug 50 is determined by the thermal plasma detection portion 12.

For example, in the AC power supply 20, the presence or absence of thermal plasma in the ignition plug 50 can be estimated with accuracy from a change in voltage waveform or change in current waveform at any given spot. In another case of an automobile, the presence or absence of thermal plasma in the ignition plug 50 may be determined from a power consumption amount or voltage drop of a battery, and in this case, the accuracy is low, but the low cost can be achieved.

At the generation of thermal plasma, a larger current flows through the center electrode 52 than at the generation of low-temperature plasma, and the thermal plasma that has once occurred is sustained while the AC voltage is being applied. This causes output to exceed a permitted value in the AC power supply 20 when thermal plasma occurs, which raises a fear that the AC power supply 20 may cause a failure. Therefore, in order to avoid a failure of the AC power supply 20, when thermal plasma is detected, it is required to set the application time period shorter to reduce a load on a power supply.

Figure 6:
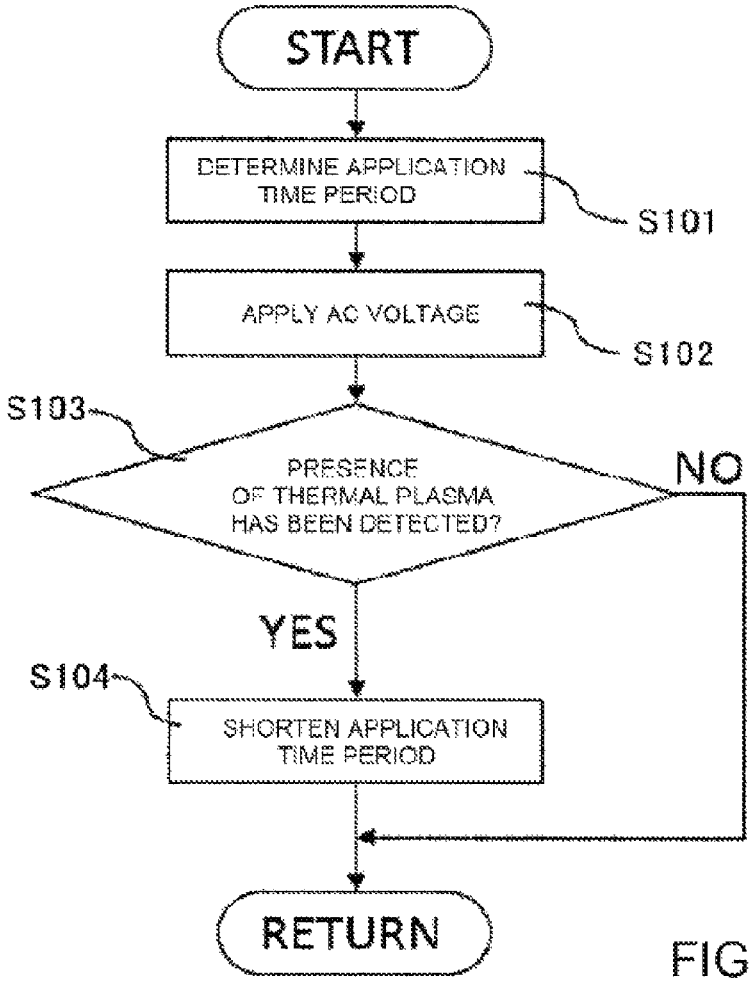
FIG. 6 is a schematic flow chart for illustrating an example of a control flow of the ignition device according to the first embodiment of the present invention.

FIG. 6 is a schematic flow chart for illustrating an example of a control flow of the ignition device according to the first embodiment of the present invention. In Step S101, the control unit 10 determines, by the application time period determination portion 11, the application time period before ignition is started. After that, in Step S102, the control unit 10 controls the AC power supply 20 to apply an AC voltage to the ignition plug 50 based on the application time period determined in Step S101.

Then, while the AC voltage is being applied, in Step S103, the control unit 10 determines, by the thermal plasma detection portion 12, the presence or absence of thermal plasma. When the control unit 10 determines that thermal plasma is present, the control unit 10 advances to Step S104 to shorten the application time period.

This processing of Step S104 for shortening the application time period is applied from a cycle at a time point at which thermal plasma is detected, to thereby be able to reliably reduce the load on the power supply. In another case, the control unit 10 may shorten and set the application time period from a cycle following the cycle at a time point at which thermal plasma is determined to be present or after the determination is performed a plurality of times. In that case, the load on the power supply increases for a certain time period, but it is possible to improve robustness against a malfunction due to noise.

When the application time period is shortened in Step S104, the control unit 10 sets a time period after thermal plasma is detected until the application is to be stopped so as to ensure a time period corresponding to at least half a cycle of the AC voltage. Under a state in which thermal plasma is generated by the ignition plug 50, no barrier discharge is generated. Therefore, under this state, the ignition is performed by the thermal plasma, but stable ignition requires a time period corresponding to at least half a period.

Therefore, in order to carry out the stable ignition in combination with protection of the AC power supply 20, it is required to set the application time period obtained after the shortening to become shorter than the preset application time period so that the time period after thermal plasma is detected until the application is to be stopped corresponds to the time period corresponding to at least half a cycle of the AC voltage.

For example, it is assumed that thermal plasma is detected at a time point of 1.5 ms after the application of the AC voltage when an AC voltage of 5 kHz is set with an application time period of 3 ms under a normal state. In this case, a cycle of the AC voltage is 0.2 ms, and half a cycle is 0.1 ms. Therefore, the control unit 10 resets the application time period obtained after the shortening so as to become equal to or longer than 1.6 ms and shorter than 3.0 ms after the application of the AC voltage.

When a time period obtained by adding half a cycle of the AC voltage after the time point of the detection of thermal plasma becomes longer than the preset application time period, the control unit 10 preferentially sets the shorter application time period. That is, the control unit 10 prevents the application time period to be reset from becoming longer than the preset application time period.

As described above, according to the first embodiment, there is provided a configuration in which the presence or absence of thermal plasma is detected during the ignition processing, and when thermal plasma is determined to have occurred, the time period to apply the AC voltage to the ignition plug is shortened. There is also provided a configuration in which the application time period can be reset so that the time period corresponding to at least half a cycle of the AC voltage is ensured as the time period after thermal plasma is detected until the application is to be stopped.

As a result, it is possible to achieve the barrier-discharge-type ignition device capable of avoiding a failure while maintaining minimum ignition performance even when the dielectric body of the ignition plug electrically breaks down. That is, it is possible to achieve the ignition device capable of igniting fuel with stability without causing a failure in the ignition device even when the ignition plug is damaged.

Second Embodiment

A second embodiment of the present invention aims at further expansion of the function of the ignition device according to the first embodiment described above by adding a partial component thereto. In the following description, portions configured to perform the same functions as those in the first embodiment described above are denoted by the same reference symbols, and duplicate descriptions are omitted as appropriate.

Figure 7:
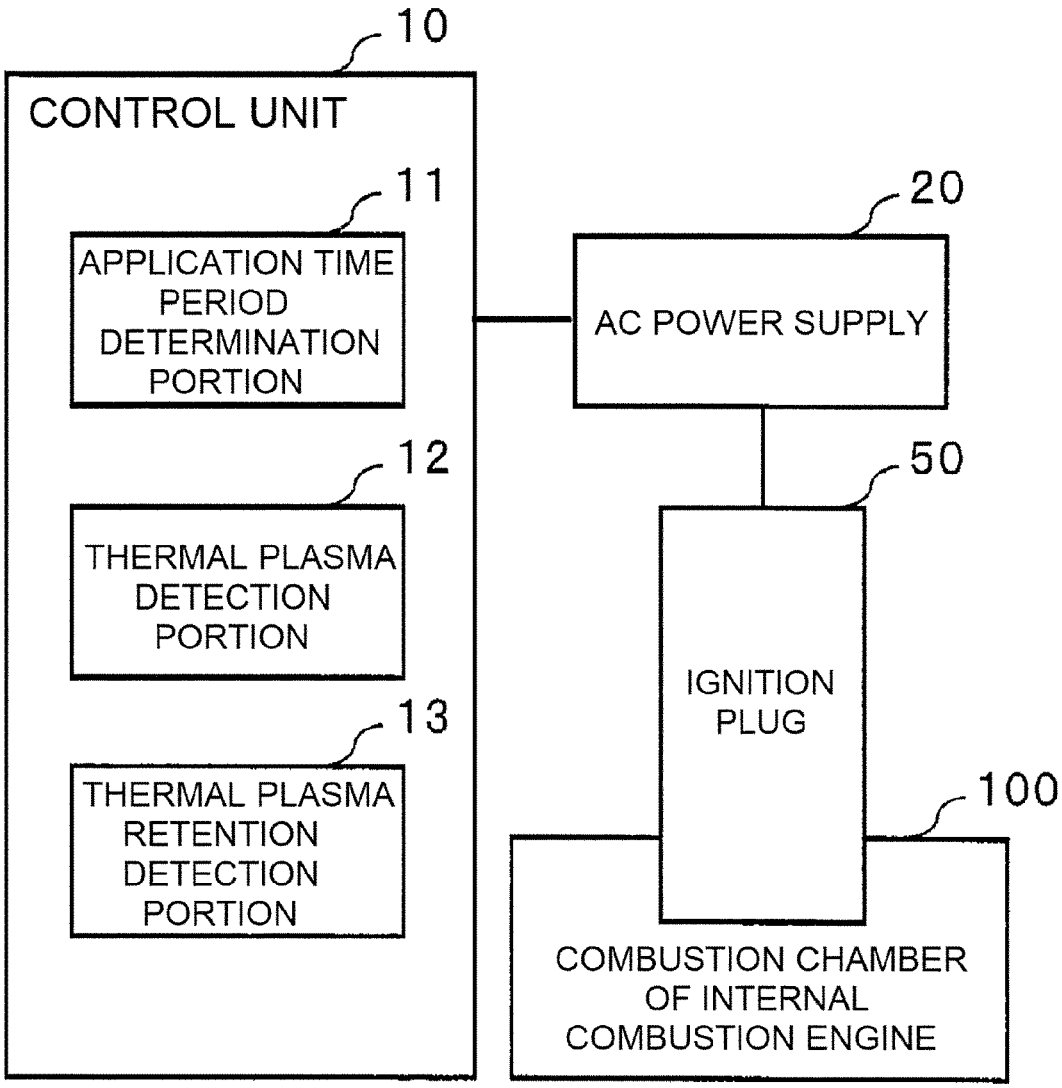
FIG. 7 is a schematic diagram for illustrating an example of a configuration of an ignition device according to a second embodiment of the present invention.

FIG. 7 is a schematic diagram for illustrating an example of a configuration of an ignition device according to the second embodiment of the present invention. The second embodiment further includes a thermal plasma retention detection portion 13 configured to detect whether or not thermal plasma is retained for a period exceeding a time period corresponding to half a cycle of the AC voltage generated by the AC power supply 20 to output a thermal plasma retention signal. The thermal plasma detection portion 12 described in the first embodiment is used for the detection of thermal plasma. The thermal plasma retention detection portion 13 then determines whether or not the state in which thermal plasma is present, which is detected by the thermal plasma detection portion 12, is retained.

The case in which the thermal plasma that has once occurred is retained without disappearing during the period of applying the AC voltage is described above with reference to FIG. 5. However, thermal plasma may not always be retained, and may occur intermittently.

Figure 8:
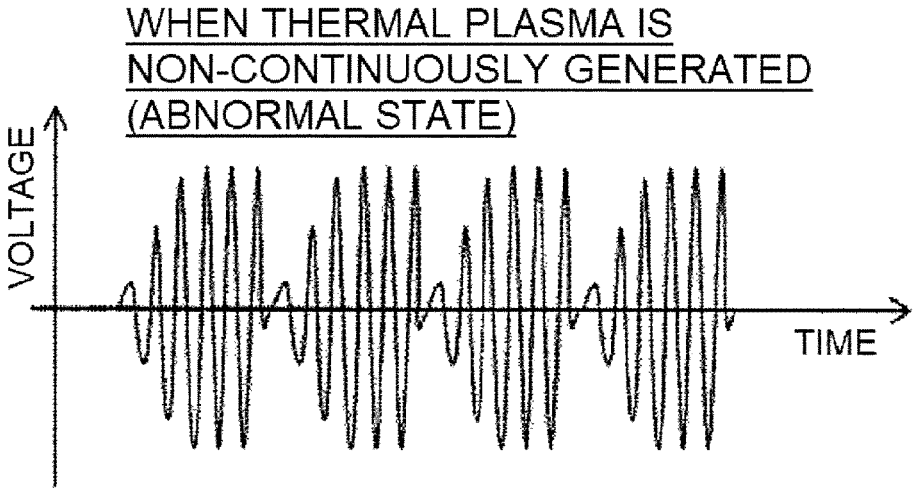
FIG. 8 is a schematic diagram for illustrating an example of a waveform of an AC voltage exhibited when thermal plasma intermittently occurs in the ignition device according to the second embodiment of the present invention.

FIG. 8 is a schematic diagram for illustrating an example of a waveform of an AC voltage exhibited when thermal plasma intermittently occurs in the ignition device according to the second embodiment of the present invention. When thermal plasma occurs, the LC resonance is no longer established. Therefore, an amplification period of a voltage due to the LC resonance occurs again.

The thermal plasma is retained when a time period during which the positive or negative of the AC voltage is reversed is shorter than a time period during which the thermal plasma that has occurred disappears. In contrast, the thermal plasma disappears when the time period during which the positive or negative of the AC voltage is reversed is longer. That is, as the frequency of the AC voltage becomes lower, thermal plasma is more likely to occur intermittently. One of the features of the second embodiment is that a method of adjusting the application time period is changed depending on whether or not it has been detected that the thermal plasma is retained.

Figure 9:
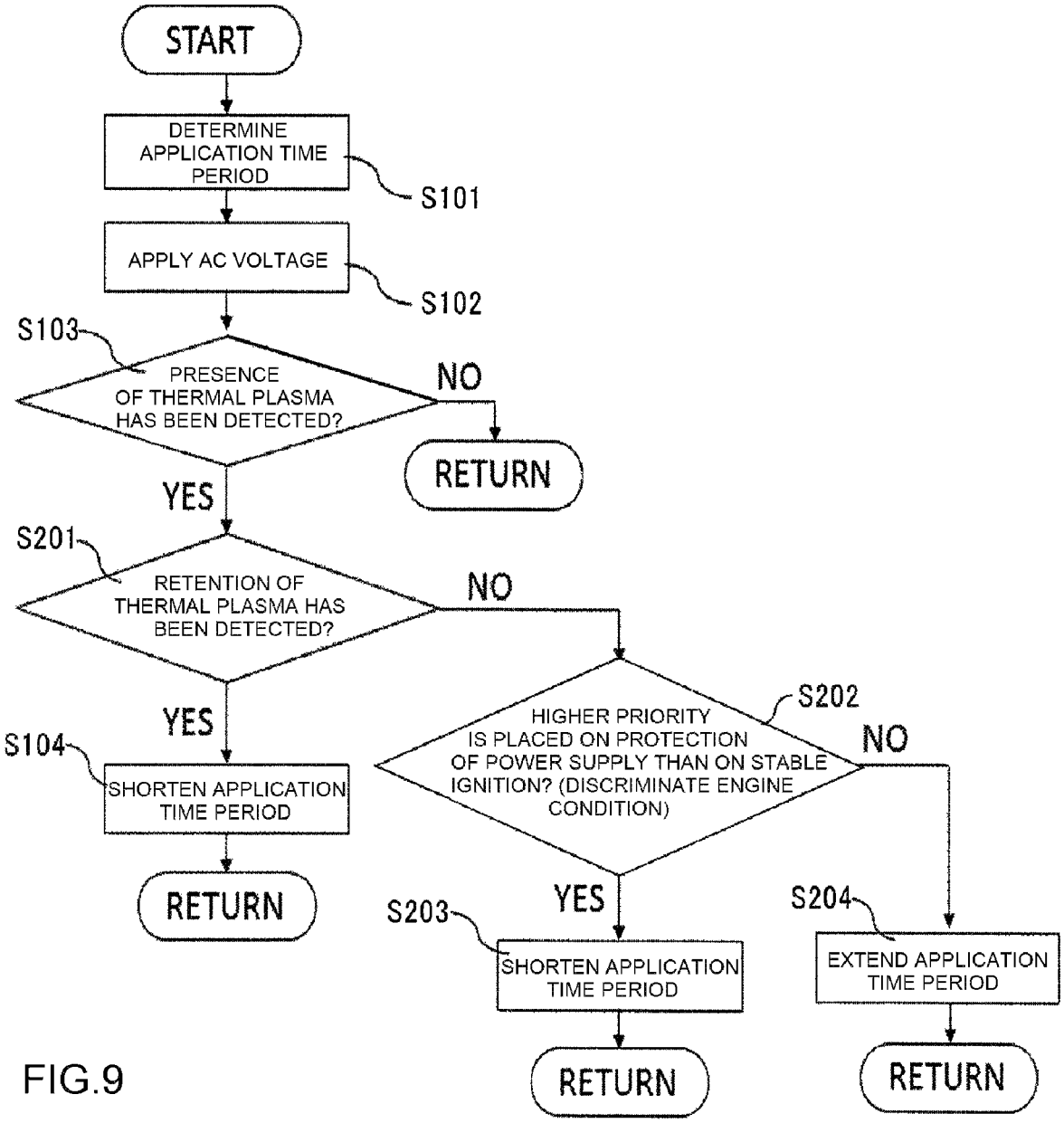
FIG. 9 is a schematic flow chart for illustrating an example of a control flow of the ignition device according to the second embodiment of the present invention.

FIG. 9 is a schematic flow chart for illustrating an example of a control flow of the ignition device according to the second embodiment of the present invention. Step S101 to Step S103 are the same as those in the first embodiment described above. When it is determined in Step S103 that thermal plasma is present, the control unit 10 advances to Step S201 to determine whether or not the retention of the thermal plasma has been detected by the thermal plasma retention detection portion 13.

When it is determined in Step S201 that the retention of the thermal plasma has been detected, the processing advances to Step S104, and the control unit 10 shortens the application time period.

Meanwhile, when it is determined in Step S201 that the retention of the thermal plasma has not been detected, that is, when it is determined that thermal plasma occurs intermittently, the processing advances to Step S202. In Step S202, the control unit 10 discriminates the operating condition of the internal combustion engine.

Specifically, the control unit 10 discriminates this operating condition based on the rotation speed of the internal combustion engine. The power supplied from the AC power supply 20 increases as the rotation speed becomes higher. Therefore, when the rotation speed is high, the control unit 10 places high priority on the protection of the AC power supply 20, and advances to Step S203 to shorten the application time period.

Meanwhile, when the rotation speed is low, the load on the AC power supply 20 is relatively small, and hence the control unit 10 places high priority on the stable ignition, and advances to Step S204 to extend the application time period. The control unit 10 can determine whether to branch off to Step S203 or Step S204 by setting a given rotation speed as a threshold value. That is, on the whole, the control unit 10 changes the setting so that the application time period becomes shorter as the rotation speed becomes higher, while the application time period becomes longer as the rotation speed becomes lower.

When executing the processing of Step S202, the control unit 10 may discriminate the engine condition based on the load on the internal combustion engine or the air-fuel ratio in place of the rotation speed. It is easier to perform the stable ignition under a condition that the load is high or the air-fuel ratio is low. Therefore, when the condition that the load is high or the air-fuel ratio is low is established, the control unit 10 advances to Step S203 to shorten the application time period. Meanwhile, when a condition that the load is low or the air-fuel ratio is high is established, the control unit 10 may advance to Step S204 to extend the application time period.

When the engine condition is discriminated based on the rotation speed, the control based on the protection of the AC power supply 20 is executed. Meanwhile, when the engine condition is discriminated based on the load or the air/fuel ratio, the control based on the stable ignition is executed. In both cases, the effect of achieving both the protection of the power supply and the stable ignition is produced.

When the retention of the thermal plasma is not detected in Step S201, the control unit 10 may execute processing for increasing the frequency of the AC voltage instead of discriminating the engine condition in Step S202. By increasing the frequency of the AC voltage, it is possible to intentionally retain the thermal plasma. As a result, it is possible to omit Step S202, to thereby produce the effects of simplified control and higher speed.

As described above, according to the second embodiment, there is further provided a configuration in which the time period to apply the AC voltage to the ignition plug can be changed to an appropriate value in consideration of the retention state of the thermal plasma and the engine condition. As a result, it is possible to achieve both the protection of the power supply and the stable ignition with higher accuracy than in the first embodiment described above. In particular, even when thermal plasma occurs intermittently, it is possible to appropriately adjust input energy based on the operation state of the engine.

Third Embodiment

A third embodiment of the present invention aims at further expansion of the function of the ignition device according to the second embodiment described above by adding a partial component thereto. In the following description, portions configured to perform the same functions as those in the second embodiment described above are denoted by the same reference symbols, and duplicate descriptions are omitted as appropriate.

Figure 10:
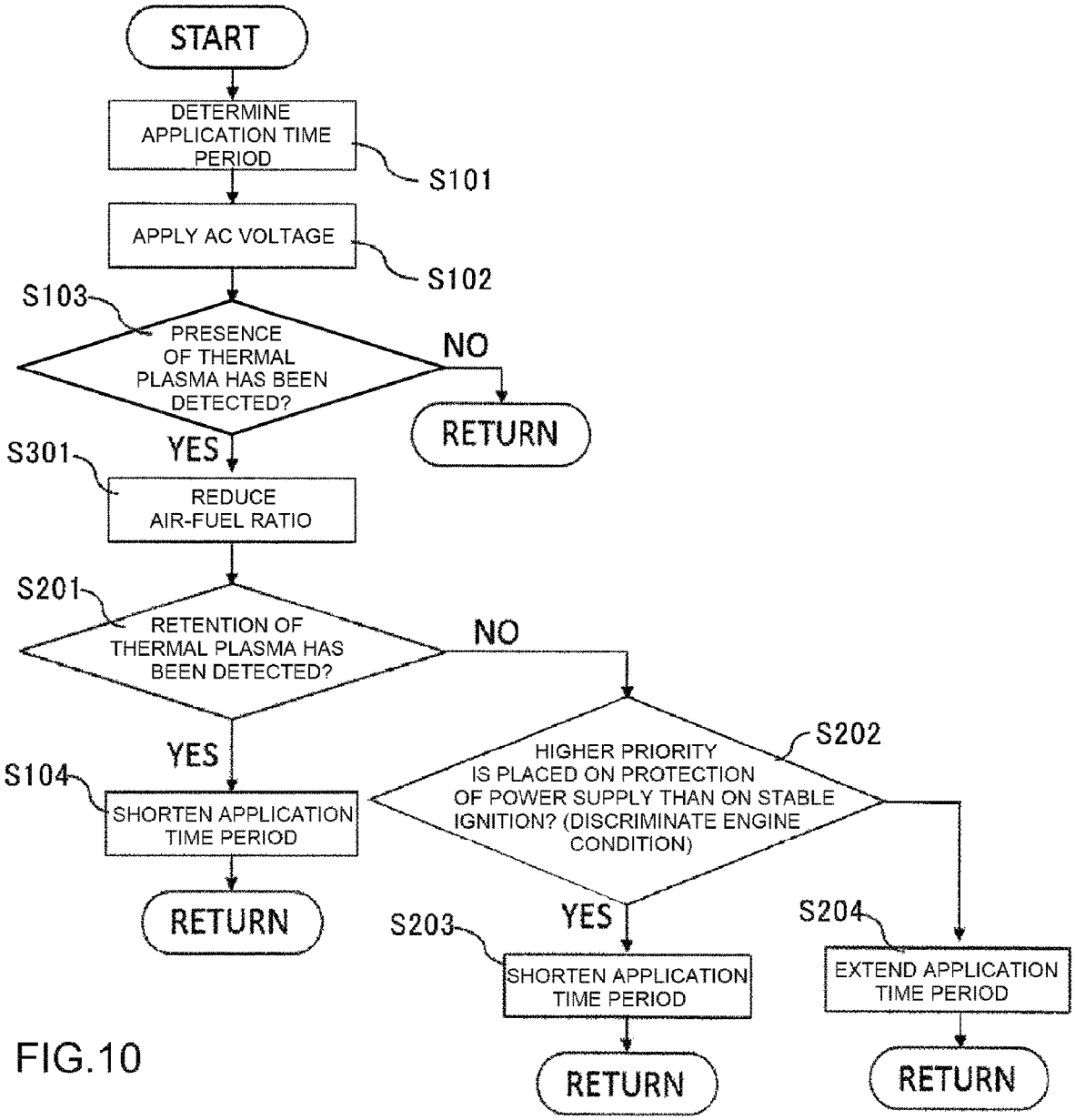
FIG. 10 is a schematic flow chart for illustrating an example of a control flow of an ignition device according to a third embodiment of the present invention.

In the third embodiment, there is further provided air-fuel ratio reduction processing for outputting a signal for lowering a mixing ratio of air to fuel in the internal combustion engine when thermal plasma is detected. FIG. 10 is a schematic flow chart for illustrating an example of a control flow of an ignition device according to a third embodiment of the present invention.

In FIG. 10, an air-fuel ratio reduction processing step of Step S301 is further provided in addition to the series of procedures of processing described above with reference to the flowchart of FIG. 9. More specifically, when thermal plasma is detected in Step S103, the control unit 10 advances to Step S301 to execute the air-fuel ratio reduction processing.

That is, the control unit 10 in the third embodiment lowers the air-fuel ratio when thermal plasma is detected, to thereby establish a condition that facilitates the stable ignition. By executing such air-fuel ratio reduction processing, it is possible to set the application time period shorter than in the case in which the air-fuel ratio is not lowered, to thereby facilitate the protection of the power supply. That is, when shortening the application time period later in Step S104, the control unit 10 can make the amount of shortening larger than that in the second embodiment described above.

In addition, by executing the air-fuel ratio reduction processing in Step S301, the control unit 10 can set the application time period to be obtained after the changing in Step S203 or Step S204 shorter than in the second embodiment described above on the whole even after the engine condition is discriminated in Step S202.

The control unit 10 can also place high priority on the protection of the power supply, and ignore Step S204 to advance the processing solely to Step S203 instead. By advancing the processing solely to Step S203 in the processing after Step S202, it is possible to simplify and speed up the control.

When detecting thermal plasma, the control unit 10 outputs a signal for resetting the ignition timing, and when the air-fuel ratio is reduced, outputs a signal for retarding the ignition timing based on the reduction amount. By optimizing the ignition condition, it is possible to produce the effect of causing stable combustion even when the ignition plug is damaged.

Such a series of air-fuel ratio reduction processes can also be executed by, for example, the thermal plasma detection portion 12 included in the control unit 10.

As described above, according to the third embodiment, there is further provided a configuration in which the condition that facilitates the stable ignition under an abnormal state in which the dielectric body has electrically broken down is established by reducing the air-fuel ratio when thermal plasma is detected. As a result, it is possible to achieve both the protection of the power supply and the stable ignition with higher accuracy than in the second embodiment described above.

REFERENCE SIGNS LIST

10 control unit, 11 application time period determination portion, 12 thermal plasma detection portion, 13 thermal plasma retention detection portion, 20 AC power supply, 21 DC power supply, 22 DC/DC converter, 23 switching element, 24 step-up transformer, 25 resonance coil, 50 ignition plug, 52 first electrode, 53 dielectric body, 54 second electrode, 55 discharge region

The invention claimed is:

1. An ignition device, comprising:

an ignition plug, for use with an internal combustion engine, and including a first electrode, a second electrode, and a dielectric body arranged between the first electrode and the second electrode;

an AC power supply configured to generate an AC voltage to be applied between the first electrode and the second electrode; and a controller configured to:

detect whether thermal plasma has occurred between the first electrode and the second electrode, and when the thermal plasma is detected, generate a thermal plasma occurrence signal;

determine an application time period for the AC voltage during one cycle of the internal combustion engine in advance before an application of the AC voltage, and when the thermal plasma occurrence signal is generated while the AC voltage is being applied based on the application time period, change the application time period so as to shorten the application time period; and detect whether the thermal plasma is retained during half a cycle of the AC voltage after the thermal plasma is detected, and generate a thermal plasma retention signal when the thermal plasma is retained, wherein, when the thermal plasma occurrence signal is generated and the thermal plasma retention signal is generated, the controller is further configured to change the application time period so as to shorten the application time period.

2. The ignition device according to claim 1, wherein, when the thermal plasma occurrence signal is generated and the thermal plasma retention signal is not generated even after the half a cycle of the AC voltage has elapsed after the thermal plasma is detected, the controller is further configured to determine the application time period based on a rotation speed of the internal combustion engine, and change the application time period so that the application time period becomes shorter as the rotation speed becomes higher.

3. The ignition device according to claim 1, wherein, when the thermal plasma occurrence signal is generated and the thermal plasma retention signal is not generated even after the half a cycle of the AC voltage has elapsed after the thermal plasma is detected, the controller is further configured to determine the application time period based on a load on the internal combustion engine, and change the application time period so that the application time period becomes shorter as the load becomes higher.

4. The ignition device according to claim 1, wherein, when the thermal plasma occurrence signal is generated and the thermal plasma retention signal is not generated even after the half a cycle of the AC voltage has elapsed after the thermal plasma is detected, the controller is further configured to determine the application time period based on a mixing ratio of air to fuel in the internal combustion engine, and change the application time period so that the application time period becomes shorter as the mixing ratio of air to fuel becomes lower.

5. The ignition device according to claim 1, wherein, when the thermal plasma is detected, the controller generates a signal for lowering a mixing ratio of air to fuel in the internal combustion engine.

6. The ignition device according to claim 2, wherein, when the thermal plasma is detected, the controller generates a signal for lowering a mixing ratio of air to fuel in the internal combustion engine.

7. The ignition device according to claim 3, wherein, when the thermal plasma is detected, the controller generates a signal for lowering a mixing ratio of air to fuel in the internal combustion engine.

8. The ignition device according to claim 4, wherein, when the thermal plasma is detected, the controller generates a signal for lowering the mixing ratio of air to fuel in the internal combustion engine.

* * * * *